United States Patent [19]

Vater

[11] Patent Number: 4,457,046

[45] Date of Patent: Jul. 3, 1984

[54] TRACK ROLLER CARRIAGE ASSEMBLY FOR SUPPORTING A SLIDING DOOR, PANEL OR THE LIKE

[76] Inventor: Lance M. Vater, 9 Redounau Crescent, Wattle Park, Australia, 5066

[21] Appl. No.: 337,902

[22] Filed: Jan. 7, 1982

[30] Foreign Application Priority Data

Aug. 4, 1981 [AU] Australia ..... PF0040

[51] Int. Cl.[3] ..... E05D 13/02

[52] U.S. Cl. ..... 16/95 R; 16/98; 16/102; 16/106; 105/155

[58] Field of Search ..... 16/87.4 R, 87.4 W, 91, 16/94 R, 94 D, 95 R, 95 D, 95 W, 95 DW, 96 R, 96 D, 96 L, 102, 103, 106, 107, DIG. 27, 98; 308/187.1; 105/148, 155; 104/89, 94, 108, 247; 198/473

[56] References Cited

U.S. PATENT DOCUMENTS

| | | | |
|---|---|---|---|
| 616,813 | 12/1898 | Sumner | 105/155 |
| 1,931,796 | 10/1933 | Hoffman | 16/106 X |
| 2,746,776 | 5/1956 | Brunner, Jr. | 308/187.1 X |
| 2,915,344 | 12/1959 | Zeller | 308/187.1 |
| 2,941,657 | 6/1960 | Newcomb et al. | 104/94 X |
| 3,006,701 | 10/1961 | Curtis | 308/187.1 |
| 3,046,594 | 7/1962 | Sherron | 16/106 X |
| 3,086,482 | 4/1963 | Fiegel et al. | 104/94 X |
| 3,194,236 | 6/1965 | Leach | 104/94 X |
| 3,384,429 | 5/1968 | Farrell et al. | 308/187.1 |
| 4,304,446 | 12/1981 | Goodine | 308/187.1 |

FOREIGN PATENT DOCUMENTS

| | | | |
|---|---|---|---|
| 668060 | 10/1934 | Fed. Rep. of Germany | 16/106 |
| 1405931 | 9/1975 | United Kingdom | 16/91 |

*Primary Examiner*—Fred A. Silverberg

*Attorney, Agent, or Firm*—Townsend and Townsend

[57] ABSTRACT

A track roller carriage assembly, a pair of joining plates joined face to face and each having a half-round deformation portion intermediate its ends, the two deformation portions defining a bolt aperture the upper edges of the joining plates being notched downwardly to provide receiving shoulders, and a suspension bolt having on it a head which contains slots which engage side faces of the joining plates adjacent the notches to thereby prevent rotation of the suspension bolt itself.

7 Claims, 3 Drawing Figures

TRACK ROLLER CARRIAGE ASSEMBLY FOR SUPPORTING A SLIDING DOOR, PANEL OR THE LIKE

This invention relates to a track roller carriage assembly of the type which is used in a narrow mouth channel-type track.

BACKGROUND OF THE INVENTION

Narrow mouth channel tracks are standard configuration tracks in many applications, and the usual track roller carriage assembly is provided with two pairs of rollers, the rollers of each pair being transversely aligned and being carried on opposite ends of a respective axle, there being provided a pair of joining plates secured face to face and supporting the two axles for rotation, the joining plates intermediate their ends however being deformed with half-round deformations through which a suspension bolt passes, the rollers engaging inturned flanges of the track.

In prior art carriage assemblies, the joining plates have been welded together, the suspension bolt has been threaded into the half-round deformations and subsequently welded, and there has been no provision for retention of grease or prevention of ingress of dust into the bearings or the spindles.

The main object of the invention is to provide a track roller carriage assembly of simpler construction than heretofore.

BRIEF SUMMARY OF THE INVENTION

In this invention there are provided in a track roller carriage assembly, a pair of joining plates joined face to face and each having a half-round deformation portion intermediate its ends, the two deformation portions defining a bolt aperture the upper edges of the joining plates being notched downwardly to provide receiving shoulders, and a suspension bolt having on it a head which contains slots which engage side faces of the joining plates adjacent the notches to thereby prevent rotation of the suspension bolt itself. This avoids the need for the suspension bolt to be welded to the joining plates.

More specifically, the invention consists of a track roller carriage assembly comprising a pair of joining plates, means retaining the joining plates in face to face contiguity as a sub-assembly, each joining face having a centrally located outwardly extending deformation portion which co-operates with the other said deformation portion to form a bolt aperture, surfaces extending from the top of the joining plate sub-assembly defining a pair of notches which extend upwardly from receiving shoulders at the mouth of said bolt aperture, and a suspension bolt extending downwardly through said bolt aperture, the bolt having a head itself having surfaces defining slots extending radially inwardly from diametrically opposite sides and engaging the side faces of the sub-assembly when the bolt head is engaged by surfaces defining said sub-assembly notches, a pair of transversely extending parallel bearings carried by said sub-assembly, axles extending through and journalled for rotation in respective said bearings, and track engaging roller wheels carried by said axles.

However, roller carriage assemblies are often used for heavy loads, for example large "sliding" doors, and frequently are used in association with tracks which are at a tilt, with the consequence that only two of the four rollers engage the tracks, and sometimes the carriage will drag against the inner surface of one of the two vertical walls. Even if properly installed, a high wind loading against a door can cause these conditions to occur.

To reduce this possibility, in one embodiment of this invention there is a clearance between the depending bolt and walls defining the bolt aperture, of sufficient magnitude to allow a small degree of freedom such that it is unlikely that any carriage wheels will cease to engage the track.

To still further reduce this possibility, in one embodiment of this invention a track roller assembly comprises a central sub-assembly, a pair of spaced parallel bearings carried by the sub-assembly, a pair of axles journalled for rotation in the bearings and extending transversely from the sub-assembly, two pairs of track engaging roller wheels, one each end of each said axle, a spindle upstanding from the central sub-assembly, a lateral roller, and a bearing between the lateral roller and the spindle journalling the lateral roller for rotation about a vertical axis, said lateral roller having two portions thereof lying laterally beyond said track engaging roller wheels.

Smooth operation of a track roller carriage assembly over a long period of time is partly dependent upon maintaining good working surfaces between the roller spindles and their bearings, and in one embodiment of this invention the axles each are surrounded by a plurality of needle rollers which are themselves carried within a bearing tube, and cup-shaped dust caps locate over the tube and retain the lubricant within the bearing, retain the bearing rollers and exclude ingress of dust.

BRIEF DESCRIPTION OF THE DRAWINGS

An embodiment of the invention is described hereunder in some detail with reference to and is illustrated in the accompanying drawings, in which.

DETAILED DESCRIPTION OF THE PREFERRED EMBODIMENT

Figure 1:
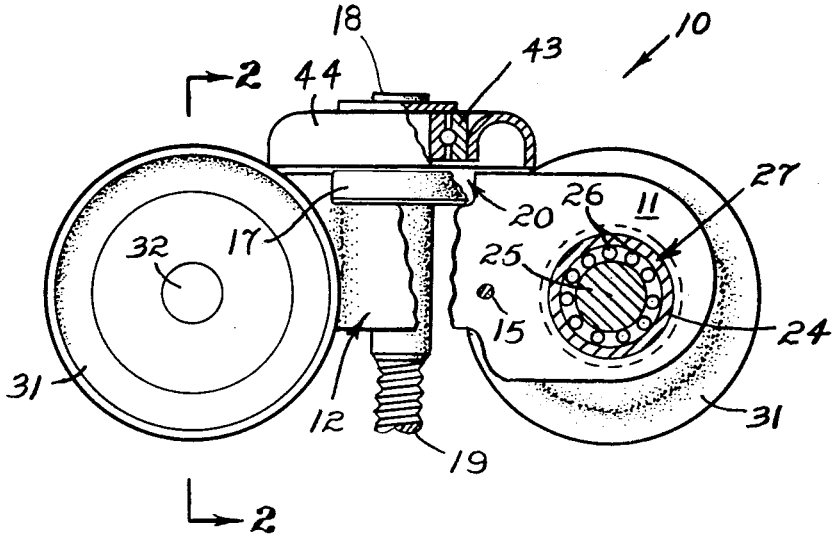
FIG. 1 is a partly sectional side elevation of a track roller assembly.

In this embodiment a track roller carriage assembly 10 comprises a pair of joining plates 11 which are substantially flat plates but intermediate their ends have half-round deformation portions 12 which between them define a generally circular bolt aperture 13. The joining plates 11 are joined in face to face contiguity by a pair of rivets 15.

Figure 3:
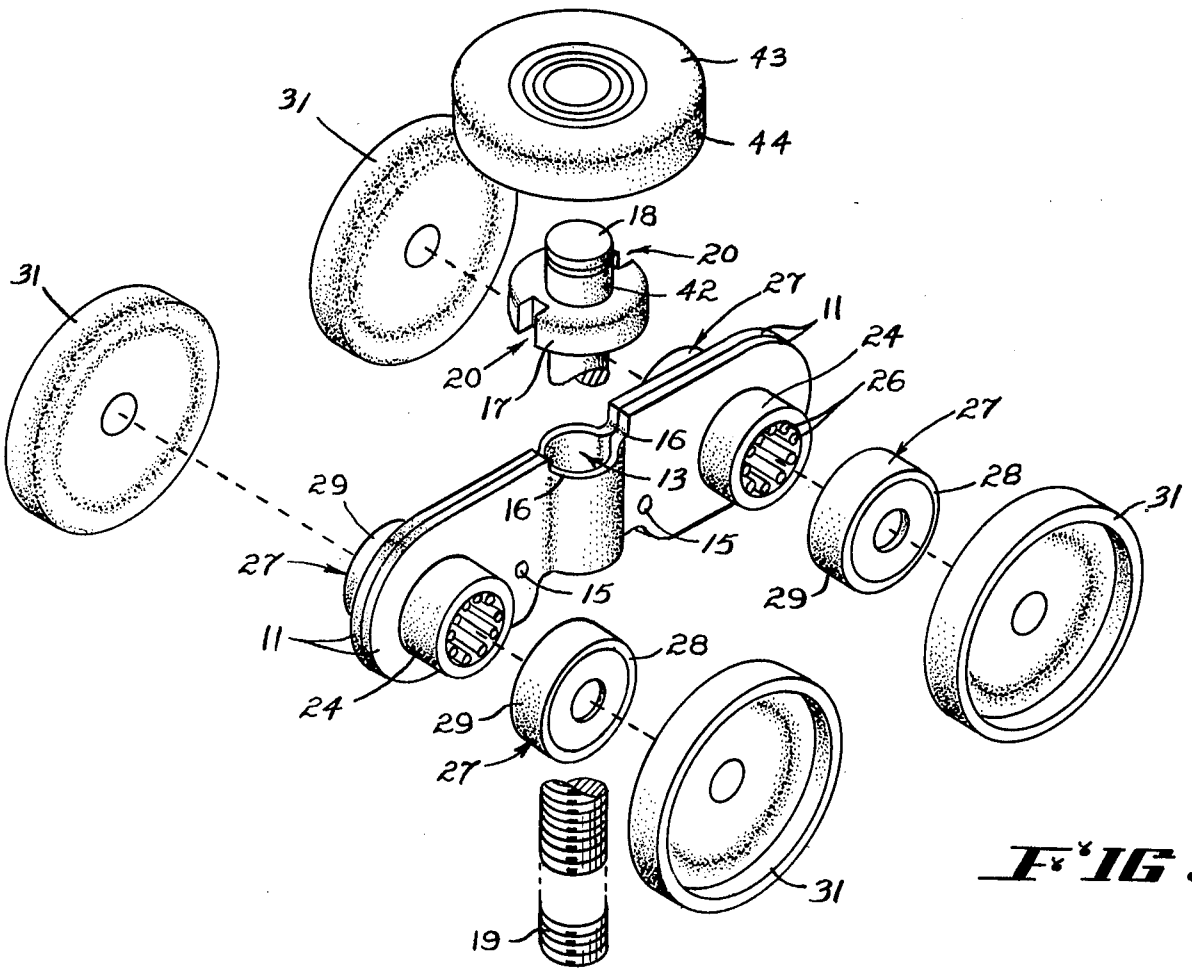
FIG. 3 is an "exploded" view of the track roller assembly (but not showing the track roller axles).

Intermediate the ends of the joining plates, the upper edges have notch forming surfaces which extend downwardly to provide a pair of flat receiving shoulders 16 in the same horizontal plane (FIG. 3), and these receiving shoulders receive a head 17 which is near upper end 18 of a suspension bolt 19.

The head 17 of the suspension bolt 19 is a generally discoid member, and this is itself provided with surfaces which define a pair of diametrically aligned slots 20 one on each side, and the surfaces which define the slots 20 of the head 17 lie contiguous with the outer faces of the joining plates 11, thereby inhibiting rotation of the suspension bolt 19.

The suspension bolt 19 extends through the bolt aperture 13, to have sufficient clearance to accommodate some misalignment of carriage and track.

The joining plates 11 are symmetrical about a central vertical transverse plane, and equally spaced from that plane are provided two pairs of apertures through which are pressed respective bearing tubes 24, each bearing tube 24 itself surrounding a respective axle 25 (not shown in FIG. 3), and there being interposed between them a plurality of circumferentially spaced needle rollers 26. The needle rollers 26 are retained in place by a pair of cup-like dust caps 27 each of which has a generally discoid outer portion 28 and a skirt 29 extending towards the joining plates, the skirt surrounding and lying contiguous with the bearing tube outer surface.

Each axle 25 has a relatively large diameter central portion and two reduced diameter ends, and each of the reduced diameter ends carries on it a respective track engaging roller wheel 31, the roller wheels 31 being secured against the shoulders between the reduced diameter ends and the relatively large diameter central portion by means of riveted ends 32 of the axles 25.

With this arrangement, not only is welding completely eliminated from the assembly, but the use of a head (which may be a forged head) on the depending bolt ensures that a higher factor of safety can exist than with welding. The bearing arrangement is much superior to prior art bearing arrangements, and the dust caps perform the functions of preventing ingress of dust, retaining the needle rollers in their correct location, retaining the grease, and retaining the tube against lateral displacement.

Figure 2:
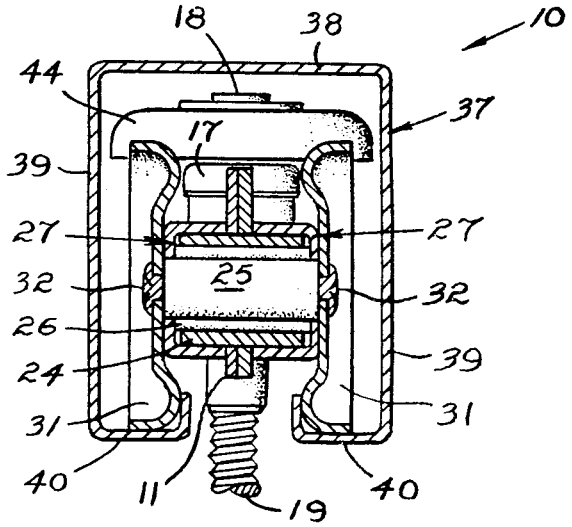
FIG. 2 is a cross-section taken on line 2—2 of FIG. 1, but further including a cross-section through a narrow mouth track having inturned flanges engaged by the rollers.

As shown in FIG. 2, a track 37 is of general C-shape, having an upper horizontal web 38, and two vertical flanges 39 depending from the web, each vertical flange itself terminating in a lower inturned track flange 40, and this is engaged by the roller wheels 31 of the track roller carriage assembly 10.

A light ball bearing 43 is carried by the spindle 42 which forms the upper end 18 of the suspension bolt 19, and the outer face of bearing 43 has pressed thereon a lateral roller 44, the lateral roller 44 being an annular member of general U-shaped cross-section, the U-shape being defined by inner and outer flanges. The inner flange engages the outer surface of the bearing 43, while the outer flange normally lies a short distance inwardly from each of the track vertical flanges 39, but laterally beyond the track engaging roller wheels 31. The dimensions are such that upon lateral displacement or tilting of the carriage assembly, firstly the bolt 19 moves in its bolt aperture 13, and upon further displacement or tilting, the lateral roller 44 engages the inner surface of one of the track vertical flanges 39 before the carriage can jam on that surface, and it is found that this greatly improves the operation of a so-called "sliding" door under quite adverse conditions.

I claim:

1. A door track roller carriage assembly comprising a pair of joining plates, said joining plates having outer side faces, means retaining the joining plates in face to face contiguity as a sub-assembly, each joining face having a centrally located outwardly extending deformation portion which co-operates with the other said deformation portion to form a bolt aperture, surfaces extending from the top of the joining plate sub-assembly defining a pair of notches which extend upwardly from receiving shoulders at the mouth of said bolt aperture, and a suspension bolt extending downwardly through said bolt aperture, the bolt having a head itself having surfaces defining slots extending radially inwardly from diametrically opposite sides and engaging the outer side faces of the joining plates when the bolt head is engaged by surfaces defining said sub-assembly notches, a pair of transversely extending parallel bearings carried by said sub-assembly, axles extending through and journalled for rotation in respective said bearings, and track engaging roller wheels carried by said axles.

2. A door track roller carriage assembly according to claim 1 wherein the space between the walls of said bolt aperture exceeds the suspension bolt diameter by an amount sufficient to allow some tilting movement of the bolt in said aperture.

3. A door track roller carriage assembly according to either claim 1 or claim 2 wherein said bearings comprise a pair of bearing tubes extending through apertures in the walls of said joining plates and retained by said joining plates, a plurality of needle rollers interposed between said axles and their respective said bearing tubes, and a respective pair of cup-shaped dust caps carried by said bearing tubes, each said dust cap having an outer portion retaining the needle rollers of that said bearing against lateral displacement.

4. A door track roller carriage assembly according to claim 1 wherein each axle has a centrally located relatively large diameter portion and two relatively small diameter end portions, each end portion comprising a rivet retaining a respective said track engaging wheel.

5. A door track roller carriage assembly according to claim 1 comprising a spindle upstanding from said sub-assembly, a lateral roller and a bearing between the lateral roller and the spindle journalling the lateral roller for rotation about a vertical axis, said lateral roller having two portions thereof lying laterally beyond said track engaging roller wheels.

6. A door track roller carriage assembly according to claim 5 wherein said spindle is upstanding from said bolt head and is formed as a linear extension of said bolt.

7. In operative combination, a door track roller carriage assembly according to either claim 5 or claim 6 and a narrow mouth channel track, the narrow mouth channel track having an upper web, a pair of spaced vertical flanges, and a pair of inturned track flanges, said track engaging roller wheels engaging and being supported by said track flanges, said suspension bolt depending from said track roller assembly between said track flanges, and said lateral roller having its two said portions adjacent the inner faces of respective said vertical flanges, and engageable against a respective one of those vertical flanges upon tilting of said assembly.

* * * * *